United States Patent [19]

Schepp et al.

[11] 4,004,376

[45] Jan. 25, 1977

[54] KITCHEN WARE CLEANING DEVICE

[75] Inventors: Edwin F. Schepp, Creve Coeur, Mo.; Ronald B. Coffey, Raleigh, N.C.

[73] Assignee: Monsanto Company, St. Louis, Mo.

[22] Filed: Dec. 30, 1974

[21] Appl. No.: 537,282

[52] U.S. Cl. ..... 51/181 R; 15/104.93; 15/118; 51/404

[51] Int. Cl.[2] ..... B24D 15/04; A47L 17/04

[58] Field of Search ..... 51/358, 181, 293–298, 51/394–407; 15/104.93, 118; 401/201, 23, 24; 425/805

[56] References Cited

UNITED STATES PATENTS

| | | | |
|---|---|---|---|
| 1,631,757 | 6/1927 | Peck | 51/294 |
| 2,665,528 | 1/1954 | Sternfield et al. | 51/295 |
| 2,778,044 | 1/1957 | Mikulski | 15/118 X |
| 3,175,331 | 3/1965 | Klein | 51/402 |
| 3,260,582 | 7/1966 | Zimmer et al. | 51/401 |
| 3,355,844 | 12/1967 | Abler | 51/400 |
| 3,377,643 | 4/1968 | Teng et al. | 15/118 |
| 3,414,928 | 12/1968 | Lemelson | 51/407 X |
| 3,431,689 | 3/1969 | Schnabel | 51/400 |
| 3,467,990 | 9/1969 | Kutik et al. | 425/805 |
| 3,507,010 | 4/1970 | Doleman et al. | 425/805 |
| 3,634,901 | 1/1972 | Landsberg | 15/118 |
| 3,862,522 | 1/1975 | Mednick | 51/400 |

*Primary Examiner*—Al Lawrence Smith
*Assistant Examiner*—Nicholas P. Godici
*Attorney, Agent, or Firm*—Lawrence L. Limpus

[57] ABSTRACT

A capability for both a brushing and abrasive action are provided in a unitary scrubbing device for removing food deposits which have been burned or baked onto the cooking surfaces of kitchen utensils used in food preparation. The device is comprised of a molded, thermoplastic, brushing surface which is laminated to a non-woven nylon mat in which soap and abrasives have been incorporated.

4 Claims, 2 Drawing Figures

KITCHEN WARE CLEANING DEVICE

This invention relates to a cleaning device of laminar structure which is uniquely adapted for removing food deposits which have been burned or baked onto the cooking surfaces of pots, pans and other utensils used in food preparation.

It is an object of this invention to provide a device capable of providing both a brushing and scouring action when employed to remove tenaciously adhering food particles from vessels in which food has been cooked at high temperatures.

It is a further object of this invention to provide a cleaning device of sufficient resiliency for application in the corners and crevices of cooking utensils.

It is another object of this invention to provide a cleaning device which is comfortable in the hand when being used.

It is a further object of this invention to provide a cleaning device having outstanding wear properties.

It is a still further object of this invention to provide a kitchenware cleaning device from which food particles and other debris can be easily removed by a simple water wash.

These and other objective are achieved in accordance with this invention by a device which contains both a brushing and scouring surface in a unitary laminar structue. The device is comprised of a molded, thermoplastic, brushing surface bonded to a backing which consists of a non-woven, nylon web or mat impregnated with both soap and an abrasive material.

In a preferred embodiment, the brushing surface is characterized by a base member from which a plurality of projections extend vertically at angles ranging from 60° to 90° . The base member or matrix perferably consists of parallel strips or stringers with the projections being spaced apart between the parallel strips to which they are integrally fused. In a particularly preferred structure, the projections are in clusters with each cluster arising from a cup-shaped supporting base which lies between adjacent parallel strips of the matrix with which it is integrally fused.

Figure 1:
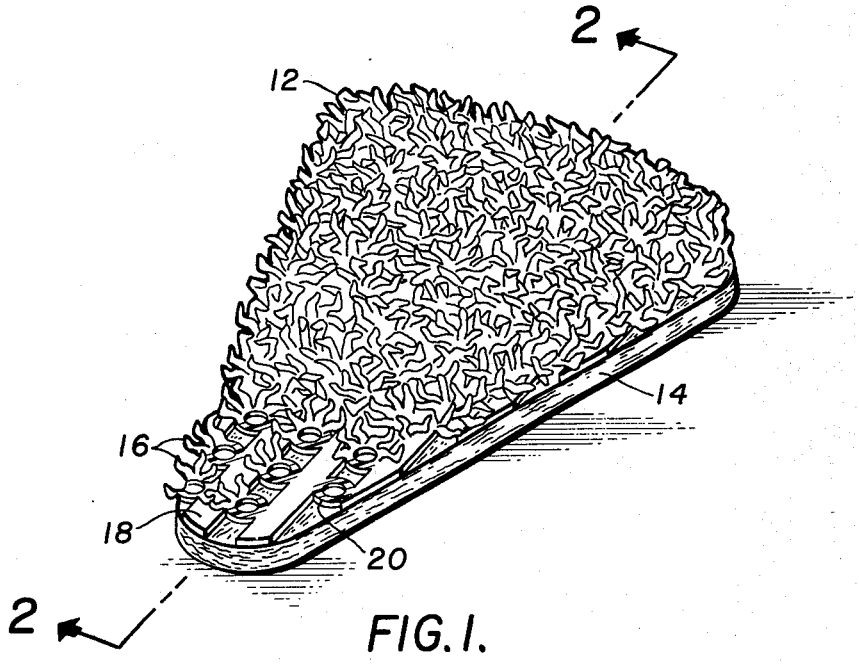
Figure 2:
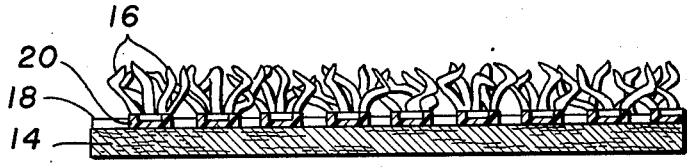

Details of the invention will be more readily understood by reference to the accompanying drawing in which FIG. 1 is a partially sectioned, isometric view of a preferred embodiment of the invention; and wherein FIG. 2 consists of a sectional view taken along the line 2′—2 of FIG. 1.

Referring to FIG. 1, the brushing surface is represented generally by the numeral 12. In the preferred configuration as shown in the drawing it is seen that finger-like projections 16 extend vertically from a base consisting of spaced apart parallel strips 18. The clusters are spaced apart between and bridge the parallel strips 18, and each cluster is integrally fused with adjacent strips at its cup-shaped support 20. The finger-like projections 16 in each cluster are integral with the cup-shaped support 20 from which they extend upwardly at various angles ranging from between about 60° to 90° .

The afore-described brushing surface and those of other configurations can be produced by well-known methods for molding thermoplastic materials. A continuous injection molding process such as described in U.S. Pat. Nos. 3,507,010 and 3,590,109 is particularly suitable. Among the molding resins which may be employed are polyolefins, such as polyethylene and polypropylene; polyvinylesters, such as polyvinyl acetate; polyamides, polyesters; polyurethane rubbers; natural rubbers and others. A particularly preferred material is low-density polyethylene.

The non-woven, nylon backing 14 generally has a thickness of from about 1/5 to ½ inch, and is preferably of a relatively loose structure. Nylon long staple or continuous filaments may be employed in preparing the mat which can be bonded with a polymeric resin. Generally, it is desirable to incorporate the abrasive material to be used in the resin bonding agent employed to achieve random distribution throughout the mat or web. Although other abrasive materials may be used, particles of aluminum oxide and/or silicone carbide having a grit size of from about 180 to 300 are especially suitable.

The impregnated non-woven backing is preferably secured to the brushing surface by a mechanical bonding procedure, although other means could be used such as, for example, adhesive bonding. The mechanical bond is achieved by pressure rolling the backing into the underside of the brushing surface while it is still hot and tacky from the molding operation. In the case where the brushing surface has been molded from a low-density polyethylene resin, bonding is achieved at a temperature in the range of from about 200° F. to 300° F. The mechanical bond is formed by embedding or entraping the the interface of the non-woven nylon mat in the molten polyethylene which, on subsequent cooling, forms the bond.

Following information of the laminate, which is usually in the form of roll goods, the finger-like projections are textured to produce a random surface with the projections at a 60° to 90° angle with the base. Also, at this time the non-woven backing is impreg- nated with a soap. The soap can be applied from a dissolved aqueous solution which is subsequently dried, or a slow release hot-melt type soap can be added by a hot roller application.

The final operation is to cut the roll goods with a die to produce the scrubber device in the shape desired. Although other shapes can be used, it has been found that the tear-drop shape as illustrated in FIG. 1 of the drawing offers substantial advantages. That is, the scrubber in this shape can be held more comfortably in the hand, it can be more readily flexed, and it is much easier to apply in crevices and corners of cooking vessels in which entry is otherwise difficult. The materials which comprise the scrubber readily accept pigments and the article can be pigmented to attractive colors if desired.

The invention may be embodied in other specific forms without departing from the spirit or essential characteristics thereof. The present embodiments are therefore to be considered as illustrative only and not restrictive, the scope of the invention being indicated by the appended claims rather than by the foregoing description and all changes which come within the meaning and range of equivalency of the claims are therefore intended to be embraced thereby.

We claim:

1. A laminar structure useful as a device for cleaning cooking vessels and other utensils used in food preparation, said laminar structure comprising: a molded thermoplastic brushing surface characterized by a base member from which a plurality of projections extend vertically from one face thereof at angles of from 60° to 90°, and wherein said projections are integrally fused with said base member; said laminate structure further including a non-woven, nylon mat which is bonded to the base member of said thermoplastic brushing surface on the face thereof opposite to that from which the projections extend, said non-woven, nylon mat having particles of an abrasive and soap impregnated therein.

2. The laminar structure in accordance with claim 1, wherein the shape of said structure is in the form of a tear-drop.

3. The laminar structure of claim 1, wherein the thickness of said nonwoven, nylon mat is in the range of from about 1/5 to ½ inch.

4. The laminar structure of claim 1, wherein said molded thermoplastic brushing surface is composed of low-density polyethylene.

* * * * *